US011819133B2

(12) United States Patent
De La Haye et al.

(10) Patent No.: US 11,819,133 B2
(45) Date of Patent: Nov. 21, 2023

(54) BODY SUPPORT ASSEMBLY

(71) Applicant: UBED B.V., Oudeschild (NL)

(72) Inventors: Cornelis Franciscus De La Haye, Oudeschild (NL); Edmund David Aufenast, De Cocksdorp (NL)

(73) Assignee: UBED B.V., Oudeschild (NL)

( * ) Notice: Subject to any disclaimer, the term of this patent is extended or adjusted under 35 U.S.C. 154(b) by 196 days.

(21) Appl. No.: 17/282,125

(22) PCT Filed: Sep. 27, 2019

(86) PCT No.: PCT/EP2019/076149
§ 371 (c)(1),
(2) Date: Apr. 1, 2021

(87) PCT Pub. No.: WO2020/069990
PCT Pub. Date: Apr. 9, 2020

(65) Prior Publication Data

US 2021/0368994 A1 Dec. 2, 2021

(30) Foreign Application Priority Data

Oct. 3, 2018 (NL) ..... 2021752
Oct. 3, 2018 (NL) ..... 2021753

(51) Int. Cl.
*A47C 21/04* (2006.01)

(52) U.S. Cl.
CPC ..... *A47C 21/044* (2013.01); *A47C 21/048* (2013.01)

(58) Field of Classification Search
CPC ..... A47C 21/04; A47C 21/042; A47C 21/044; A47C 21/046; A47C 21/048
See application file for complete search history.

(56) References Cited

U.S. PATENT DOCUMENTS

2005/0278863 A1* 12/2005 Bahash ..... A47C 21/044 5/652.2
2008/0148481 A1* 6/2008 Brykalski ..... A47C 21/048 5/423

(Continued)

FOREIGN PATENT DOCUMENTS

FR 2893826 A1 6/2007
JP 2003038297 A 2/2003

(Continued)

*Primary Examiner* — David R Hare
*Assistant Examiner* — George Sun
(74) *Attorney, Agent, or Firm* — NIXON PEABODY LLP; Ronald I. Eisenstein; Nicole D. Kling

(57) ABSTRACT

The invention is directed to a body support assembly comprising (i) an upper cushion zone (6) and a lower cushion zone (7) and separated by a separation sheet (8). The cushion zones (6, 7) comprise of a compressible material which is permeable for air in all directions, (ii) a first flow path (10) for ambient air comprising an air inlet opening (11) at the bottom surface (3) of the support assembly, air displacement means (12), a first heat exchanger (13) and a single or separate air outlet opening (14) at the bottom surface (3) of the support assembly, (iii) a second flow path for air comprising an air inlet (19), air displacement means (20), a second heat exchanger (17), through the lower cushion zone (7), through openings (23) in the separation sheet (8) and through the upper cushion zone (6) and multiple air outlets (22) in the top surface (2). The heat exchangers (13, 17) are part of a Peltier effect unit (16) positioned within the cushion volume (4).

18 Claims, 6 Drawing Sheets

(56) References Cited

U.S. PATENT DOCUMENTS

Figure 1:
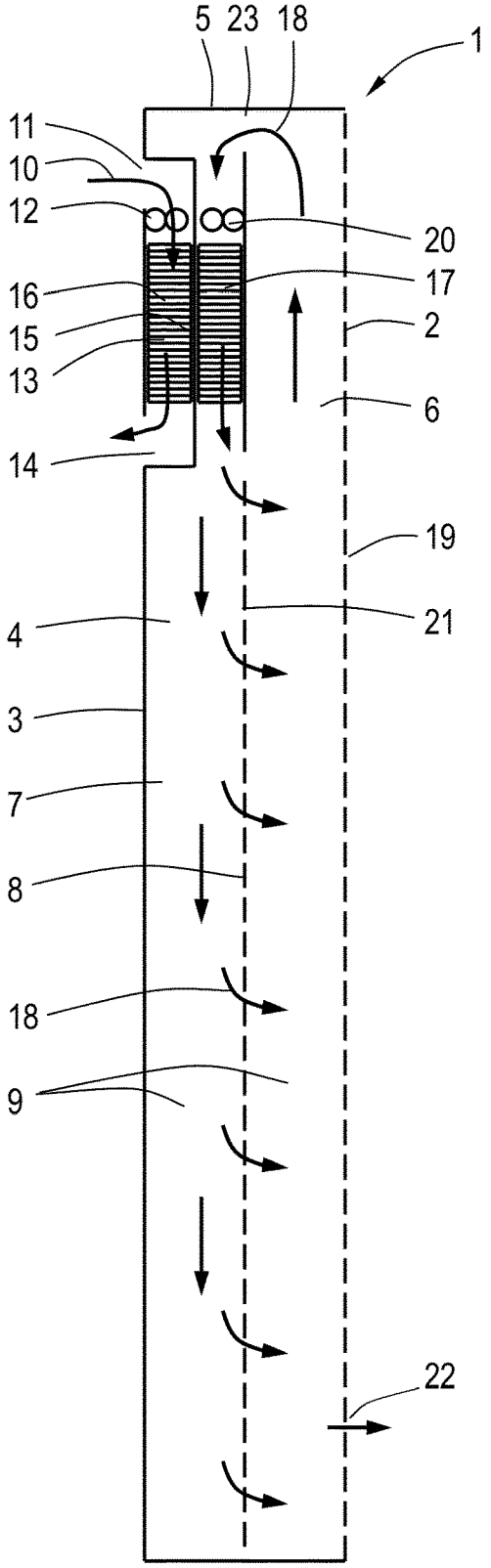

| | | | | |
|---|---|---|---|---|
| 2010/0287701 | A1* | 11/2010 | Frias | A47C 21/044 5/423 |
| 2011/0010850 | A1* | 1/2011 | Frias | A47C 21/048 5/423 |
| 2011/0041245 | A1 | 2/2011 | Shafer et al. | |
| 2011/0289683 | A1* | 12/2011 | Mikkelsen | A61F 7/02 5/690 |
| 2014/0182061 | A1* | 7/2014 | Zaiss | A61G 7/05792 5/423 |
| 2015/0247656 | A1* | 9/2015 | Parish | A47C 21/044 62/3.5 |
| 2017/0325595 | A1* | 11/2017 | DeFranks | A47C 21/048 |
| 2018/0344046 | A1* | 12/2018 | DeFranks | A47C 27/08 |

FOREIGN PATENT DOCUMENTS

| | | | |
|---|---|---|---|
| KR | 20060124553 | A1 | 12/2006 |
| WO | 2007060371 | A2 | 5/2007 |

* cited by examiner

BODY SUPPORT ASSEMBLY

CROSS-REFERENCE TO RELATED APPLICATIONS

This application is a 35 U.S.C. § 371 National Phase Entry Application of International Application No. PCT/EP2019/076149 filed Sep. 27, 2019, which claims benefit under 35 U.S.C. § 119(a) of NL Application Nos. 2021752 filed Oct. 3, 2018 and U.S. Pat. No. 2,021,753 filed Oct. 3, 2018, the contents of which are incorporated herein by reference in their entireties.

The invention is directed to a body support assembly having a top surface for supporting a body and a spaced away bottom surface defining a cushion volume and defining side walls, wherein the cushion volume comprises a heating and cooling element.

US2017/0325595 describes a mattress having foam layers and a coil spring layer provided with upwardly directed channels for directing a flow of conditioned air towards the sleeps surface.

WO2015106258 describes a mattress and bed combination wherein the bed is provided with fans to draw air from the top surface through the mattress downwardly to a lower positioned air conditioning layer. The conditioned air is discharged to the surroundings of the mattress-bed combination with the object to influence the temperature adjacent to the sleep surface.

WO2018022760 describes a mattress to support a body wherein within the mattress resistive heating elements are positioned. Such resistive heating elements may be a resistive heating coil as present between two layers in a looping or serpentine arrangement. The cooling is by a separate mechanism wherein air is pulled and the associated heat and moisture from the contact area supporting a body via one or more channels equipped with a fan. A disadvantage of the body support assembly as described is that when cooling a relatively large draft is required to cool a body supported by the body support. This is less comfortable.

WO2014204934 describes a mattress provided with numerous Peltier effect heating and cooling elements which are positioned near the top surface of the mattress in a continuous layer of a flexible foam. The top side of the elements either directly heat or cool the top side of the mattress while the opposite side of the Peltier effect elements are heated or cooled at their lower side by a flow of air being drawn through the mattress. A disadvantage of such a mattress is that the Peltier effect elements have to be positioned relatively near the surface in order to directly heat or cool the surface which supports the body. This may result in a less comfortable mattress as the body may feel the single Peltier effect elements.

The body support described in either WO2018022760 or WO2014204934 is advantageous in that the heating and cooling element are positioned within the cushion volume. This avoids that separate heating and cooling elements have to be connected to the body support assembly apart from a power supply and a control system to regulate the heating and cooling. Examples of publications describing mattresses combined with separate Peltier effect heating and cooling units are WO2016166638, WO2014145436 and WO2014/106119.

KR20060124553 describes a body support assembly with an upper zone and a lower zone. The upper zone is provided with a compressible material. The lower zone is provided with metal springs. An air heater is partly outside the support assembly and can provide warm air to the body support assembly to heat up the upper side of the assembly. The person being supported by the support assembly will feel the warmth when laying on the support sheet of the support assembly. This because hot air flowing along the lower side of the non-air permeable support sheet will heat up this support sheet.

The present invention aims to provide a body support assembly wherein a heating and cooling unit is positioned within the cushion volume and which does not have the disadvantage of the known matrass in terms of comfort.

This is achieved by the following body support assembly.

Body support assembly having a top surface for supporting a human body and a spaced away bottom surface defining a cushion volume and defining side walls, wherein the air permeability of the top surface is higher than the air permeability of the bottom surface and higher than the air permeability of the side walls, wherein the cushion volume comprises, an upper cushion zone nearest to the top surface and a lower cushion zone and separated by a separation sheet, wherein the upper cushion zone and the lower cushion zone comprise of a compressible material which is permeable for air in all directions, a first flow path for ambient air comprising a single or separate air inlet opening at the bottom surface of the support assembly, air displacement means, a first heat exchanger and a single or separate air outlet opening at the bottom surface of the support assembly, a second flow path for air comprising an air inlet, air displacement means, a second heat exchanger, a flow path through the compressible material of the lower cushion zone, through openings in the separation sheet and through the compressible material of the upper cushion zone and multiple air outlets in the top surface, and wherein first heat exchanger and second heat exchanger are part of a Peltier effect unit positioned within the cushion volume, which unit is configured to cool the air in the first flow path and heat the air in the second flow path in one operating modus and/or to heat the air in the first flow path and cool the air in the second flow path in a second operating modus.

Applicants found that it is possible to create a flow of conditioned air within the cushion volume by the Peltier effect unit as positioned within the cushion volume. By making use of cushion materials which are permeable for air in all directions in combination with the upper and lower zone it has become possible to achieve a sufficient heating or cooling function with a relatively small amount of Peltier effect units or even with one single unit. This allows the air heating and cooling unit, based on the Peltier effect, to be positioned within the body support assembly. This is advantageous because no externally positioned equipment is required.

The invention is also directed to the following method. Method to cool or heat a body support assembly having a top surface for supporting a human body and a spaced away bottom surface defining a cushion volume and defining side walls, wherein the cushion volume comprises, an upper cushion zone nearest to the top surface and a lower cushion zone and separated by a separation sheet, wherein the upper cushion zone and the lower cushion zone comprise of a compressible material which is permeable for air in all directions, and wherein ambient air flows in a first flow path via a single or separate air inlet openings at the bottom surface of the support assembly, air displacement means, a first heat exchanger and a single or separate air outlet opening at the bottom surface of the support assembly, wherein ambient air flows in a second flow path via an air inlet, air displacement means, a second heat exchanger, a flow path through the compressible material of the lower cushion zone, through openings in the separation sheet, through the compressible material of the upper cushion zone and through the top surface, and wherein the first and second heat exchangers are part of a Peltier effect unit and wherein in the first heat exchanger the air is cooled and in the second heat exchanger the air is heated in one operating modus and/or wherein in the first heat exchanger the air is heated and in the second heat exchanger the air is cooled in a second operating modus.

Further advantages will be described when discussing the various embodiments of the invention below.

The body support assembly may find use as a mattress to support a human body during sleep. The support assembly can cool or heat the human body depending on the ambient temperature in the for example the room or space in which the support assembly is positioned. For example, in a relatively hot environment the support assembly may cool the second air flow resulting in a relatively cool body support assembly and especially a relatively cool top surface. With this body support assembly there is a diminished requirement too cool the entire room or space. By only cooling the body support assembly significant energy savings are thus achieved while achieving the same reduced temperature body support, eg. sleeping, conditions. The same is true for a relatively cold environment. By increasing the temperature of the body support assembly and especially its top surface significant energy savings can be achieved while achieving the same body support, eg. sleeping, conditions.

Preferably the second flow path allows air to circulate from the second heat exchanger via the lower cushion volume to the upper cushion volume and back to the second heat exchanger. This is especially favourable when the body support assembly is not used to support a human body and when it is in a so-called stand by modus. The temperature in the body support assembly can be maintained at the desired temperature while not wasting too much energy. This because the conditioned air is being recirculated as opposed to cool or heat fresh ambient air to maintain the desired temperature. The air inlet and multiple air outlets in this circulation embodiment are present in the air permeable top surface. Some air will escape from within the upper cushion zone to the space above the top surface via the air permeable top surface while most air from within the upper cushion zone will be recirculated through the cooling and heating unit.

This circulating air flow may also be used to exterminate dust mite which may be present in the cushion volume. By increasing the temperature of the circulating air to above 50° C. and preferably above 60° C., for a certain time while the body support assembly is not used to support a human body, all of the dust mites which are exposed to this higher temperature will be exterminated.

Alternatively it may be preferred that the second flow path allows air to flow from an air inlet at the bottom surface of the support assembly via the second heat exchanger, via the lower cushion zone, via the upper cushion zone to the multiple air outlets in the air permeable top surface. This body support assembly is favourable when it is used to support a human body. The heat or cold is then not only transported to the human body via the contact surface at the top surface but also by means of the conditioned air exiting the top surface and flowing around a human body. The human body may be covered by for example a blanket, duvet or sheet in this body support assembly. Most air that will escape the resulting covered space, through openings at the sides of the cover and some air through the cover.

More preferably the body support assembly can switch from the above circulation mode to this once through, to a ventilating mode of air flow, and variations in between the two modes. For example the circulation mode may be used to prepare the body support assembly for use and the once through mode may be used when the body support assembly is used to support the human body. To achieve such use the body support assembly preferably has a valve assembly which has a valve position which allows an air flow path according to the earlier referred to air circulation and a valve position which allows an air flow path according to the earlier described one through principle. Even more preferable the body support assembly can be configured such that a combination of the circulation and one through air flows is achieved. For example, in use the human body may be covered by blankets and/or sheets which do not allow all the air to either exit the top surface or escape the air space created by the blanket or sheets. In such a situation it may be favourable to circulate part of the air within the cushion volume and/or even take in some air from the space created by the blankets or sheets and supply this air to the second heat exchanger. In this way this air may be cooled or heated to the desired temperature level for reuse. Thus preferably the valve assembly has valve positions which allow a combination of air flows according to the circulation and once through principle.

A switch from a circulation mode to a ventilating mode, and those in between, may be performed automatically when sensors measure that a human body is present on top of the body support assembly. Such sensors may for example be pressure sensors, motion sensors, displacement sensors, humidity sensors and temperature sensors. Switching back to a circulation mode may also be performed automatically when sensors detect that no human body is being supported by the body support assembly. Next to switching from one modus to another one may also control the air flow volume by controlling the capacity of the air displacement means and control the heating or cooling capacity by controlling the power to the Peltier effect unit.

The body support assembly has a top surface, side walls and a bottom surface. The top surface will face the human body which is being supported by the body support assembly. This top surface is permeable for air. In the once through principle the air outlet and inlet of the second flow path is this air permeable top surface as explained above. The air permeable top surface is also important for the once through embodiment wherein ambient air taken in at the bottom surface is conditioned and discharged via the top surface. For this to be effective it is important that the air permeability of the top surface is higher than the air permeability of the bottom surface and higher than the air permeability of the side walls. Preferably the air permeability, as measured using ASTM D 737-96, of the top surface is at least 3 times and more preferably 4 times more air permeable than the side walls and the bottom surface. An example of a material suited for such a top surface is a 3D knitted ventilating textile. The side walls should be made of a flexible material which allows that the cushion volume can be compressed to a certain extend when the assembly is used to support a human body. The elongated side walls are preferably flexible while the side walls at the extensions at head and feet end of the support may be less flexible as they typically are less compressed in use. Materials suited for such side walls are tightly woven or knitted textiles. The bottom surface may be composed of the same material as the side walls. Because the bottom surface does not necessarily have to be as flexible as the side walls also more stiff materials may be used for the bottom surface. Materials suited for use for the bottom surface are dense non-woven textiles and certain types of felt.

The Peltier effect unit, also known as thermoelectric heat pump, is a solid-state active heat pump which transfers heat from one side of the device to the other, with consumption of electrical energy, depending on the direction of the current. Such an instrument is also called a Peltier effect device, Peltier effect heat pump, solid state refrigerator, or thermoelectric cooler (TEC). In one operating modus heat is transferred, ie heat pumped, from the air in the second flow path via the Peltier effect unit to the ambient air. The conditioned air within the cushion volume is thereby cooled. In the other operating modus heat is transferred from the ambient air in the first flow path to the air in the second flow path via the Peltier unit. The conditioned air within the cushion volume is thereby heated. The Peltier effect heating and cooling unit comprises the first and second heat exchanger and a Peltier effect plate. The Peltier effect plate may have the shape of a flat plate having in use a hot and cold surface when connected to an electrical power supply. Depending on the direction of the current one side is cool and the other side is hot. When the direction of the current is changed the hot and cold side also change. This property of the Peltier effect unit is advantageously used in the body support assembly according to the invention. Namely by simply changing the direction of the current as provided to the Peltier effect unit the air in the second flow path is either cooled or heated. The heating capacity and cooling capacity are also easily controlled by adapting the power supplied to the Peltier effect unit. The air flows along first and second heat exchanger may be adapted by adapting the power to the one or more air displacement means and by adapting valve or valves position as will be explained below. By having the opposite side of the Peltier effect unit being heated respectively cooled by the air in the first flow path a balanced system is achieved. In a preferred embodiment the Peltier effect unit is thus configured to cool the air in the first flow path and heat the air in the second flow path in one operating modus and to heat the air in the first flow path and cool the air in the second flow path in a second operating modus. Preferably the flat surface of the plate of the Peltier effect unit is directly connected to heat exchange fins, preferably metal fins, which are positioned in first and second flow path. These fins act as first and second heat exchanger in first and second flow path for air respectively. In this way more effective heat exchange is achieved between the Peltier effect unit and the air flowing in respectively first and second flow path. Alternatively the Peltier effect unit may be equipped with a heat exchange surface at its, in use, cold and hot side to heat and cool separate heat transfer mediums and means to transport the separate heat transfer mediums to the first and second heat exchanger to exchange heat and/or cool the air in the first flow path and second flow path. Such a heat exchanger may be for example a shell-tube heat exchanger or a heat pipe.

The second heat exchanger in the second flow path generates the hot or cold air which determines the temperature of the body support assembly. It is preferred that this flow of conditioned air is evenly distributed from the lower cushion zone to the upper cushion zone. Such to avoid locally hot and cold areas in the top surface or hot or cold flows of air as it is exited from the top surface. In order to achieve such an even distribution of air an air distribution system may be used wherein the second heat exchanger is fluidly connected to an air outlet system with multiple air outlet openings within the compressible material of the lower cushion zone. In this way conditioned air is substantially evenly distributed within said lower cushion zone and will pass the openings in the separation sheet in a substantially evenly distributed manner. A disadvantage of such a system is distribution channels for conditioned air are required in the lower cushion zone. One can avoid such a system using a body support assembly wherein the second heat exchanger is fluidly connected to an air outlet within the lower cushion zone and wherein the openings per area of separation sheet increases for positions on the separation sheet which are spaced further away from the air outlet of the second heat exchanger. In this way substantially the same volume of conditioned air may flow per surface are of separation sheet from the lower cushion zone to the upper cushion zone.

The invention is also directed to a body support assembly, wherein the Peltier effect heating and cooling unit is configured to cool the air in the first flow path and heat the air in the second flow path in a single operation modus. In such an assembly only heated air flows in the second flow path. Such a body support assembly is suitably used in moderate climate zones. This may be explained by the fact that a small flow of heated air flows through the top surface and past the user of the body support assembly. It has been found that when the temperature of the air flowing through the upper cushion zone is just below the body temperature of the user a comfortable sleep experience is achieved. It has also been found that the volume of air required to achieve this effect may be low. This results in that the capacity of the air displacement means may be low and therefore the resulting noise may be low to almost non-detectable for the user.

The air displacement means and first and the second heat exchanger of the Peltier effect unit may be positioned anywhere within the cushion volume. For comfort reasons it may be preferred to position these elements in the lower cushion zone. This is also advantageous because the length of the first flow path can be minimised resulting in that less cushion volume is occupied by the Peltier effect unit and optional air inlet and air outlet conduits. The body support assembly may have an end for placement of the head of the human body and an end for placement of the feet of the human body. For such a body support assembly it is preferred that the Peltier effect unit or units are positioned at the end for the feet. Preferably the top surface will then comprise of an area at the end for placement of the head of the human body which is less air permeable than the average air permeability of the top surface. This is advantageous because more air will flow along the rest of the body thereby avoiding a draft along the head which may be less preferred while sleeping.

The cushion volume comprises the upper cushion zone nearest to the top surface and the lower cushion zone and separated by the separation sheet. The upper cushion zone and the lower cushion zone comprise of a compressible material which is permeable for air in all directions. Preferably more than 70 vol. %, more preferably more than 80 vol % and even more preferably more than 90 vol. % of the upper cushion zone consists of the compressible material which is permeable for air, wherein the remaining volume comprises at least the Peltier effect unit.

Such an upper and lower cushion zone allow conditioned air to freely flow from a point within the lower cushion zone to the openings in the separation sheet into the upper cushion zone. The air permeability of the material is suitably higher than 50 $cm^3/s/cm^2$, more preferably higher than 100 $cm^3/s/cm^2$ and most preferably higher than 200 $cm^3/s/cm^2$ as measured by the earlier referred to Standard Test Method for Air Permeability of Textile Fabrics, ATSM D737-96. Suitable materials are non-encased mattress coils, non-woven fabrics and knitted materials. In this invention steel spiral springs, the so called Bonell-springs or equivalents, may also be used as the compressible material which is permeable for air in all directions. Such materials may be used for both upper and lower cushion zones. Combinations of materials is also possible wherein the upper cushion zone comprises a different material than the lower cushion zone. Examples of a suitable material is the so-called warp knitted spacer fabric as described in WO2015/140259 and 2018187348. Such a warp knitted spacer fabrics have a first planar warp-knit layer and a second planar warp-knit layer joined by spacer yarns. When a warp knitted spacer fabrics is used for the upper and/or lower cushion zone the planar warp knitted layer itself may be the separation sheet. Suitably additional openings are made for transport of conditioned air from the lower cushion zone to the upper cushion zone. When for example multiple layers of warp knitted fabrics are used in one zone it is preferred to add additional openings in the planar surfaces facing the planar surface of a next warp knitted fabric.

A more preferred material for the upper and/or lower cushion zone is a so-called random loop bonded structure of a thermoplastic resin. Such materials are for example Breathair® as obtainable from Toyobo Co. and described in for example EP2848721 and EP3064627. Such materials have excellent air permeability properties which exceeds 200 $cm^3/s/cm^2$. The random loop bonded structures are advantageous because their weight per volume is low. One suitably applies this material as sheets of random loop bonded structures having an upper and lower planar sheet. These surfaces are almost as permeable for air as the air permeability of the bulk of the material. This in contrast to the earlier mentioned warp knitted fabrics.

Random loop bonded structures are made in a continuous process wherein a continuous linear structure of a polymer in a near molten state are poured into a shallow layer of for example water. The polymer will form random loops and mutually contact and connect ate these contact points to form bonded points. At the bottom and at the surface a planar random bonded structure results and between these planar surfaces a three dimensional randomly bonded structure results. This production technique limits the thickness of the sheets of random loop bonded material. The distance between these planar surfaces may for example be between 1 cm and 10 cm. Depending on the desired thickness, ie distance between top surface and bottom surface of the body assembly and the thickness of the separate cushion zones one or more layers of such random loop bonded structures may be used. In order to obtain optimal cushion properties it may be preferred to combine different layers with different compression hardness of these materials.

The number of bonded points per unit weight of the three-dimensional random loop bonded structure is between 550 and 1150 bonded points per gram, preferably between 600-1100, more preferably between 650-1050 and even more preferably between 700-1000/g. The number of bonded points per unit weight (unit: the number of bonded points/gram) is a value obtained by a measuring method described in EP2848721. In this method a piece in the form of a rectangular parallelepiped is prepared by cutting a network structure into the shape of a rectangular parallelepiped measuring 5 cm in length×5 cm in width so that the rectangular parallelepiped includes two surface layers of the sample but does not include the peripheral portion of the sample, dividing the number of bonded points per unit volume (unit: the number of bonded points/$cm^3$) in the piece by the apparent density (unit: $g/cm^3$) of the piece. The number of bonded points is measured by a method of detaching a welded part by pulling two linear structures; and measuring the number of detachments.

A random loop bonded structure has an average apparent density within a range of preferably 0.005 $g/cm^3$ to 0.200 $g/cm^3$. The random loop bonded structure having an average apparent density within the above range is expected to show the function of a cushioning material. The average apparent density of less than 0.005 $g/cm^3$ fails to provide repulsive force, and thus the random loop bonded structure is unsuitable for a cushioning material. The average apparent density exceeding 0.200 $g/cm^3$ gives great repulsive force and reduces comfortableness. This is not preferable. The apparent density in the present invention is more preferably 0.010 $g/cm^3$ to 0.150 $g/cm^3$, even more preferably within a range of 0.020 $g/cm^3$ to 0.100 $g/cm^3$.

As explained above the compression hardness of the material used may be different in for example the upper and lower cushion zone. For example, the lower cushion zone may comprise material be a layer including a somewhat hard linear structure having a thick fineness, and an upper cushion zone may comprise of material having a linear structure with a somewhat thin fineness and a high density. The lower cushion zone material may be a layer that serves to absorb vibration and retain the shape. The upper cushion zone material may be a layer that can uniformly transmit vibration and repulsive stress to the lower cushion zone so that the whole body undergoes deformation to be able to convert energy, whereby comfortableness can be improved and the durability of the cushion can also be improved. It may also be preferred to impart a thickness and tension to the side portion of the cushion material, wherein the fineness may be somewhat reduced partially and the density may be increased near the side wall. In this way, each layer may have any preferable density and fineness depending on its purpose. It should be noted that the thickness of each layer of the network structure is not particularly limited.

A preferred material which is permeable for air in all directions for the lower cushion zone are metal springs, for example Bonnell springs. The Bonnell spring has an hour glass shape (wider at the bottom and the top than the middle) and are interconnected with a mesh of metal to make the spring system. These metal springs are preferred because they on the one hand provide the required vibration absorption and ability to retain its shape and on the other hand allow air to easily flow through the metal springs without any noticeable pressure drop. The non-encased metal springs are not individually packed in a textile wrapping as for example pocket springs. The separation sheet may be as described before. A suitable separation sheet may be a sheet of a warp knitted spacer fabric as described above.

The 25%-compression hardness of the three-dimensional random loop bonded structure is between 10 and 30 kg/ϕ200-mm. The 25%-compression hardness is a stress at 25%-compression on a stress-strain curve obtained by compressing the network structure to 75% with a circular compression board measuring 200 mm in diameter.

The thermoplastic resin may be a soft polyolefin or a polyester thermoplastic elastomer. A preferred resin is the so-called P-type PELPRENE® obtainable from Toyobo Co.

which is a copolymer composed of an aromatic polyester as a hard element and an aliphatic polyether as a soft element.

The separation sheet may be an integral part of the layers of cushioning material used to provide cushioning properties to the body support assembly as explained for the warp knitted spacer fabrics. If a separate sheet is used it is preferably a flexible sheet made of a tightly woven fabric or a polymer material. The sheet will be provided with openings. The pattern and density of the openings and the size or sizes of the opening are so chosen that a preferred flow of conditioned air flows from the lower cushion zone to the upper cushion zone along substantially the total area of the separation sheet as described above. Such openings may have any shape. Circular openings may have a diameter of between 1 cm and 6 cm.

The invention is also directed to a body support assembly having a top surface for supporting a human body and a spaced away lower surface defining a cushion volume and defining side walls, wherein the cushion volume comprises a compressible material which is permeable for air in all directions has an air permeability of greater than 100 $cm^3/s/cm^2$ as measured by ASTM D737-96 and a Peltier effect unit equipped to heat and/or cool air flowing within the cushioning material. Applicants found that when the compressible material as claimed is used in the cushion volume a body support is achieved which can effectively transport conditioned air within its structure. Almost no pressure drop is encountered and the amount of conditioned air leaving the cushion volume itself may be reduced as compared to prior art solutions. This enables one to achieve similar cooling or heating results at the top surface while having to use less or even only one Peltier effect unit. The required Peltier effect unit may thus be so dimensioned that it is possible to have the Peltier effect unit positioned within the cushion volume. The preferred embodiments of this body support assembly may be as described above.

The body support assembly is preferably used as a mattress. The invention is therefore also directed to a bed comprising a body support assembly according to this invention. The bed will have some sort of structure to support the mattress. This mattress support should leave openings at its lower end to allow air to flow into the air inlet opening or openings at the bottom surface of the support assembly. A suited support for the mattress is a spiral wire support because such a support is very permeable for air.

The power supply for the Peltier effect unit and air displacement means and optional valves may be provided by means of a cable directly connected to the mattress or via the mattress support. A small power adaptor may be externally present. If the power supply is performed via the mattress support simple power exchange surfaces may be present at the exterior of the mattress which connect with power supply surfaces present on the mattress support. This may be preferred when one wishes a mattress without any cables extending from the mattress.

The invention is also directed to a method to method to cool or heat a body support assembly as described above. In this method the second flow path air may circulate from the second heat exchanger via the lower cushion volume to the upper cushion volume and back to the second heat exchanger. Alternatively, the second flow path air may flow from an air inlet at the bottom surface of the support assembly via the second heat exchanger, via the lower cushion zone, via the upper cushion zone to an air outlet which comprises the air permeable top surface. Suitably both second flow paths for air as here described can be chosen by controlling a valve or valves. Suitably both second flow paths for air as here described or combinations of both flow paths can be chosen by controlling a valve or valves. Suitably a combination of both second flow paths can be chosen by controlling a valve or valves. The method suitably is performed such that in the first heat exchanger the air is cooled and in the second heat exchanger the air is heated in one operating modus and wherein in the first heat exchanger the air is heated and in the second heat exchanger the air is cooled in a second operating modus.

The above method is suitably performed in a body support according to this invention. Preferably the method is performed in a bed, provided with a mattress and used by a human being. Preferably in a bed as described above.

The invention will be illustrated making use of the following FIGS. 1-10.

FIG. 1 shows a body support assembly (1) having a top surface (2) for supporting a human body and a spaced away bottom surface (3) defining a cushion volume (4) and defining side walls (5). An upper cushion zone (6) nearest to the top surface (2) and a lower cushion zone (7) are separated by a separation sheet (8). The upper cushion zone (6) and the lower cushion zone (7) comprise of a compressible material (9).

A first flow path (10) for ambient air is shown wherein air enters the body support assembly (1) via an air inlet opening (11) at the bottom surface (3) of the support assembly, as drawn in by a ventilator (12) as the air displacement means to a first heat exchanger (13). The air is cooled or heated in the heat exchanger (13) and the heated or cooled air is discharged from the body support assembly (1) via air outlet opening (14) at the bottom surface (3). Heat exchanger (13) are fins connected to the Peltier plate (15) of a Peltier effect unit (16). The opposite side of the Peltier plate (15) is connected to fins which form the second heat exchanger (17). As shown the Peltier effect heating and cooling unit (16) is positioned within the cushion volume (4).

In FIG. 1 air in the second flow path is allowed to circulate from the second heat exchanger (17) via the lower cushion volume (7) to the upper cushion volume (6) and back to the second heat exchanger (17). In this second flow path air also flows from an air inlet (19) being the air permeable top surface (2) to a ventilator (20) as the air displacement means to the second heat exchanger (17). In heat exchanger (17) the air is cooled or heated depending on the temperature requirements. The conditioned air exits the second heat exchanger (17) and flows through the lower cushion zone (7) and through openings (21) in the separation sheet (8) to the upper cushion zone (6). Some of the air will exit the upper cushion zone (6) via the multiple air outlets (22) in the air permeable top surface (2), while the majority of the air circulates to the second heat exchanger (17). In separation sheet (8) an opening (23) is present which allows this recirculating air to flow from the upper cushion zone (6) to the ventilator (20).

When the second heat exchanger (17) is configured to cool the air in the second flow path (18) the air in first flow path (10) is heated in heat exchanger (13). The ventilators (12) and (20) can be controlled to achieve the optimal air flows through the heat exchangers. This control will depend on maintaining a desired temperature in the upper cushion zone and the chosen operating modus, ie cooling or heating.

Figure 2:
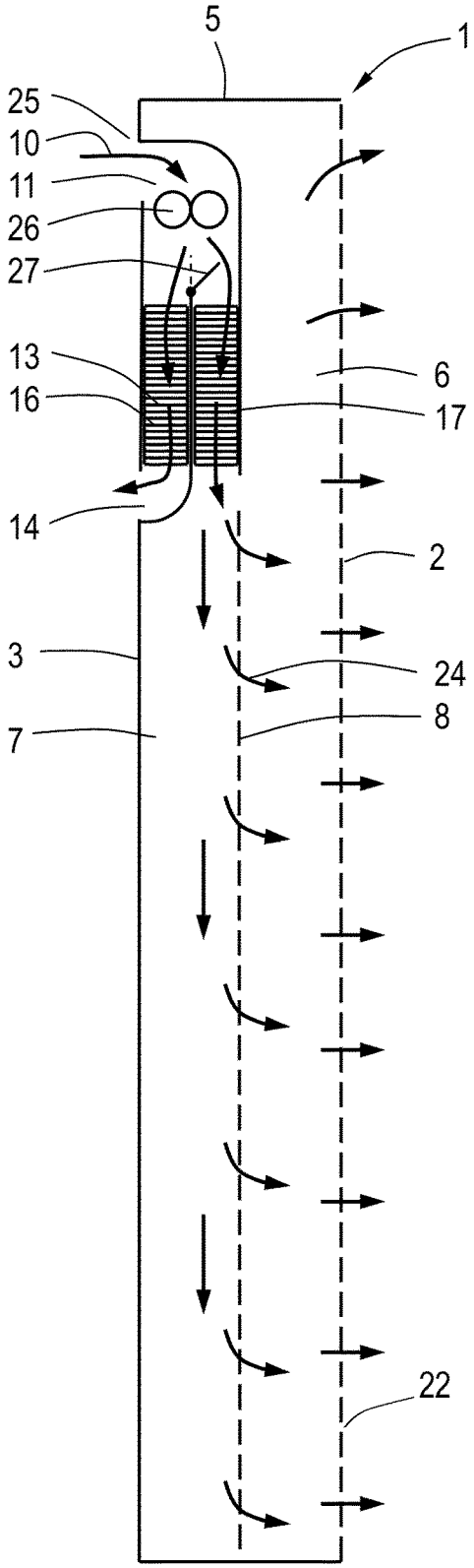

In FIG. 2 a similar body support assembly is shown as in FIG. 1. The main difference is the second air flow path. In this figure the second flow path (24) allows air to flow from an air inlet (25), which is the same as air inlet (11) for the first flow path (10), at the bottom surface (3) of the support assembly via the second heat exchanger (17), via the lower cushion zone (7), via the upper cushion zone (6) to an air outlet (22) which comprises the air permeable top surface (2). Thus air is conditioned and exited from the body support assembly via outlet (22) in a once through arrangement and is not recirculated to the second heat exchanger (17) as in FIG. 1.

In the assembly of FIG. 2 air is drawn in through inlet (11,25) by a single ventilator (26). A flap (27) which position may be controlled divides the flow of air to the first heat exchanger (13) and second heat exchanger (17). The position of the flap (27) will for example change when the current in the Peltier effect unit is reversed resulting in that an air flow changes from being cooled to be heated.

Figure 3:
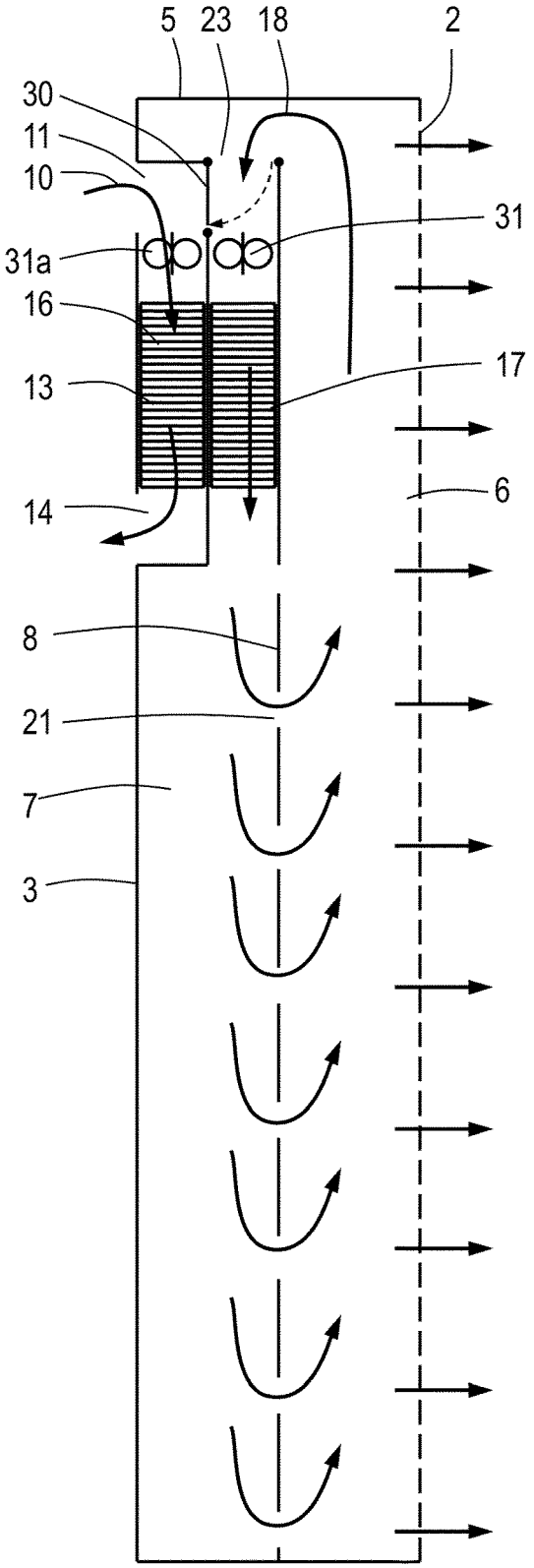
Figure 4:
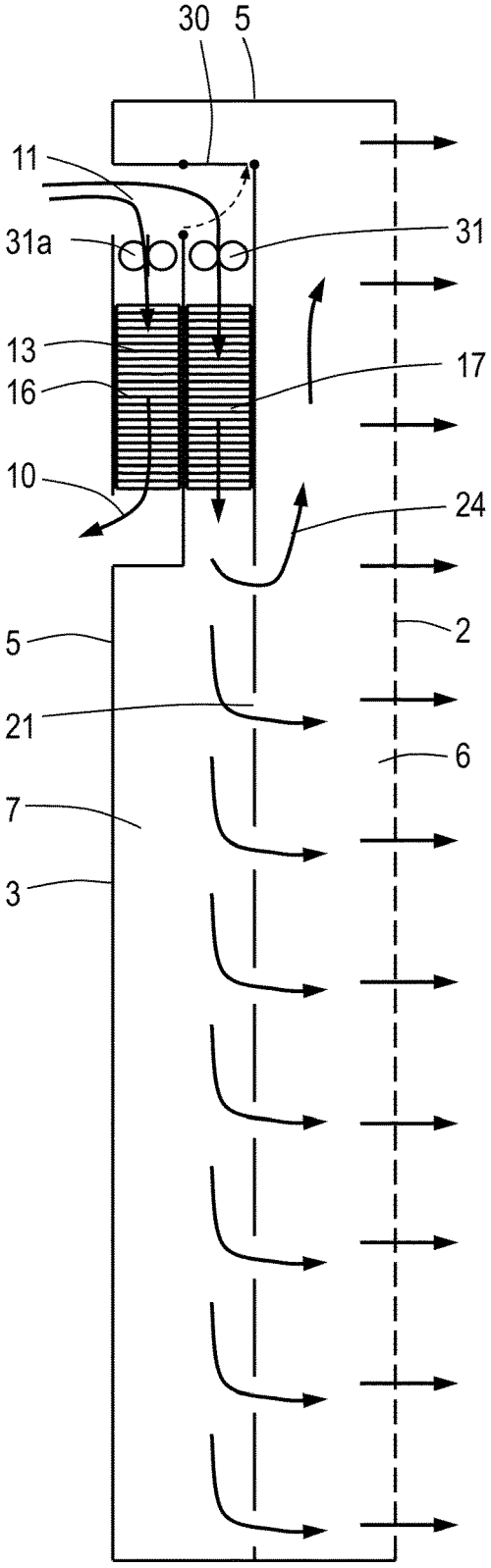

FIGS. 3 and 4 show an embodiment of the body support assembly provided with a valve assembly (30) which has a valve position as shown in FIG. 3 which allows an air flow path (18) as shown in FIG. 1 and a valve position as shown in FIG. 4 which allows an air flow path (24) as shown in FIG. 2.

In FIG. 3 shows that valve assembly (30) has a position wherein air is drawn in from the upper cushion zone (6) by a second ventilator (31) thereby creating opening (23) which fluidly connects the upper cushion zone with the ventilator (31) and the downstream second heat exchanger (17). The first flow path (10) is directed by means of a different first ventilator (31*a*) along first heat exchanger (13) and is fluidly separated from the second flow path (18). In FIG. 4 the valve assembly (30) is positioned such that opening (23) is enclosed and wherein air inlet opening (11) at the bottom surface (3) of the support assembly is fluidly connected to both first and second ventilators (31*a*,31). The air flow along first and second heat exchanger (13,17) will be controlled by the ventilator speed of ventilators (31*a*,31).

Figure 5:
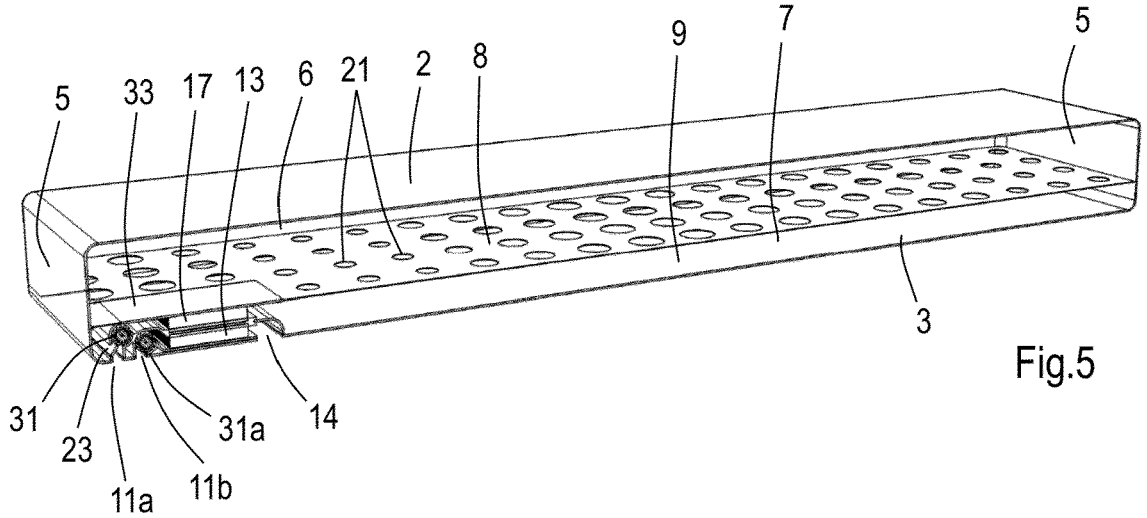

FIG. 5 shows a cross-sectional three dimensional view of the body support assembly according to the one shown in FIGS. 3 and 4. In this Figure it is shown that the size of the openings (21) in separation sheet (8) varies. This pattern results in that air flows from the lower cushion zone (7) to upper cushion zone (6) will be evenly distributed in the area where the human body will be supported. The openings (21) near the Peltier unit are large in size and will be mainly function to flow air from the upper cushion zone (6) to the inlet opening (23) of the Peltier unit when air is recirculated as shown in FIG. 3. The Peltier unit shown in FIG. 5 is described in more detail in FIG. 6*a-c*.

Figure 6A:
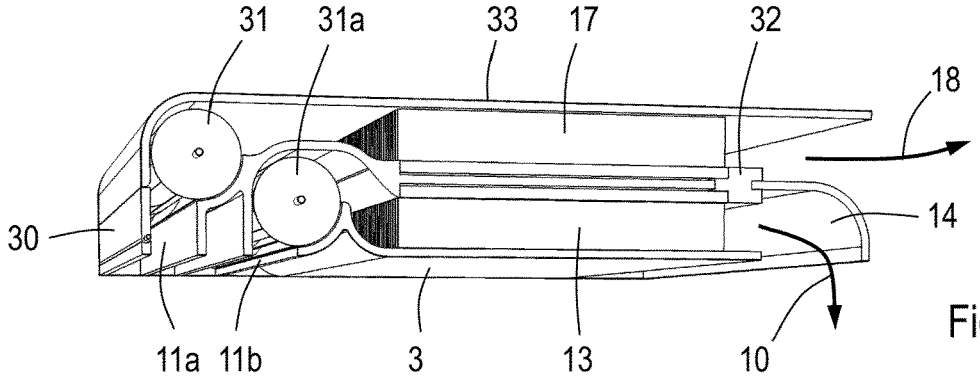
Figure 6B:
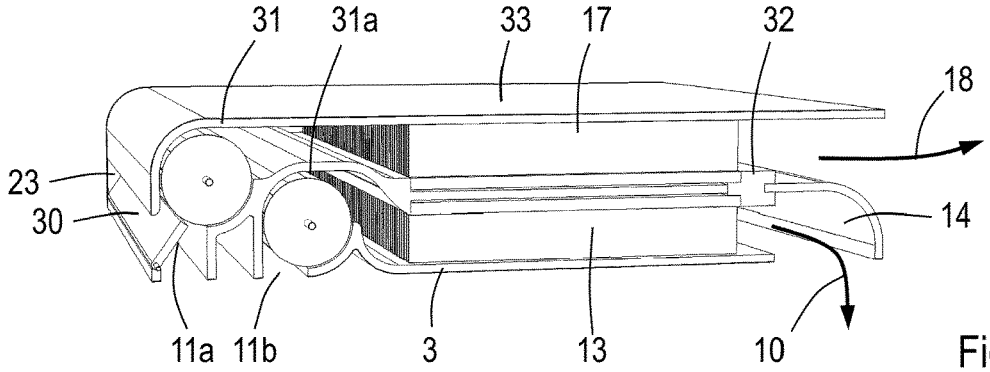
Figure 6C:
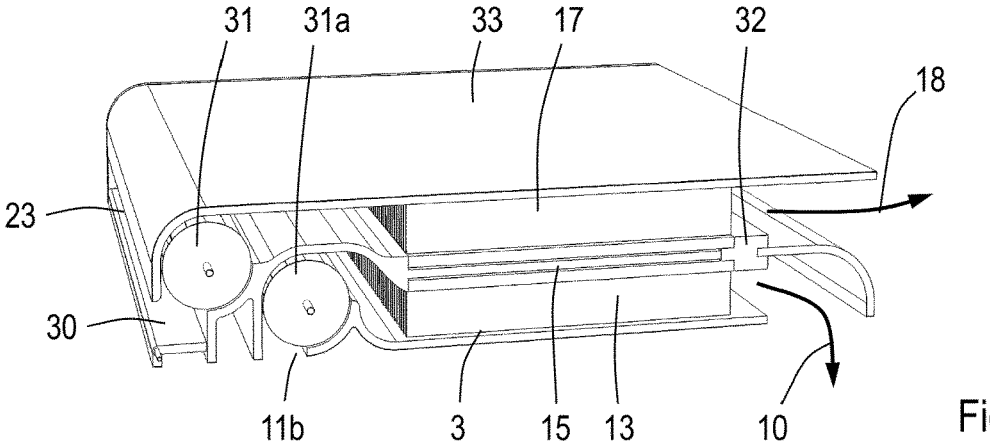

FIG. 6*a*-6*c* shows the Peltier effect unit for the support assembly as shown in FIG. 3-5. The ventilators 31*a* and 31 may be so-called centrifugal fans. In this figure also a foam strip (32) is shown onto which condensate water may accumulate. For example, water may condensate when cooling the air. The liquid water may accumulate and be transported to the warmer flow in the parallel air flow path. The liquid water will evaporate at the surface of the foam strip facing the warmer flow of air in this parallel flow path. The Peltier effect unit in this figure is provided with a top 33 which separated the second heat exchanger (17) from the surrounding compressible material (9). The lower end of the Peltier effect unit may be part of the bottom surface (3) of the support assembly.

In these Figures different positions for valve assembly (30) are shown. Valve assembly (30) in these figures is positioned differently from FIGS. 3 and 4 but the effect is the same. In FIG. 6*a* valve (30) closes of opening (23) and air is drawn in from by ventilator (31*a*) via opening (11*b*) to first heat exchanger (13) and air is drawn in by ventilator (31) via opening (11*a*) to second heat exchanger (17). The valve position in FIG. 6*a* is thus the same as in FIG. 4.

In FIG. 6*b* valve (30) is positioned in an intermediate position wherein ventilator (31) draws in air from the upper cushion zone (6) via opening (23) and draws in air via opening (11*a*) to second heat exchanger (17). Valve (30) may be rotated to influence the area of the inlet opening (23) and (11*a*) such to regulate the ratio between re-circulating air and ambient air in the air flow to second heat exchanger (17).

In FIG. 6*c* valve (30) is positioned such that it encloses opening (11*a*) resulting in that ventilator (31) draws in air only from the upper cushion zone (6) via opening (23) to second heat exchanger (17). The valve position in FIG. 6*a* is thus the same as in FIG. 3.

Figure 7:
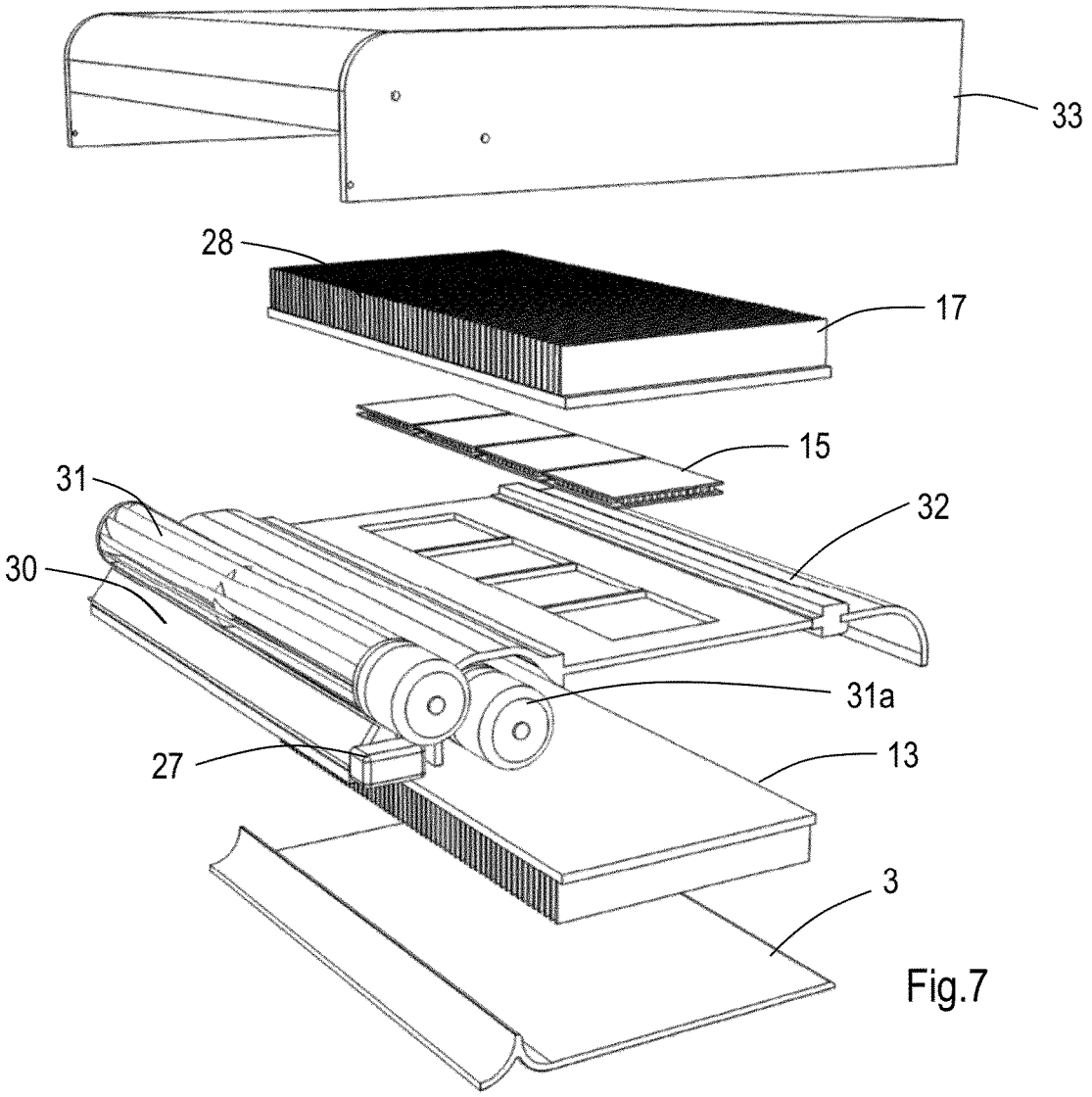

FIG. 7 shows an exploded view of the Peltier effect element of FIG. 6*a-c*. In this figure the heat exchange fins (28) and the Peltier effect plate (15) are shown. An electric servo motor (27) is shown which drives the valve (30).

Figure 8:
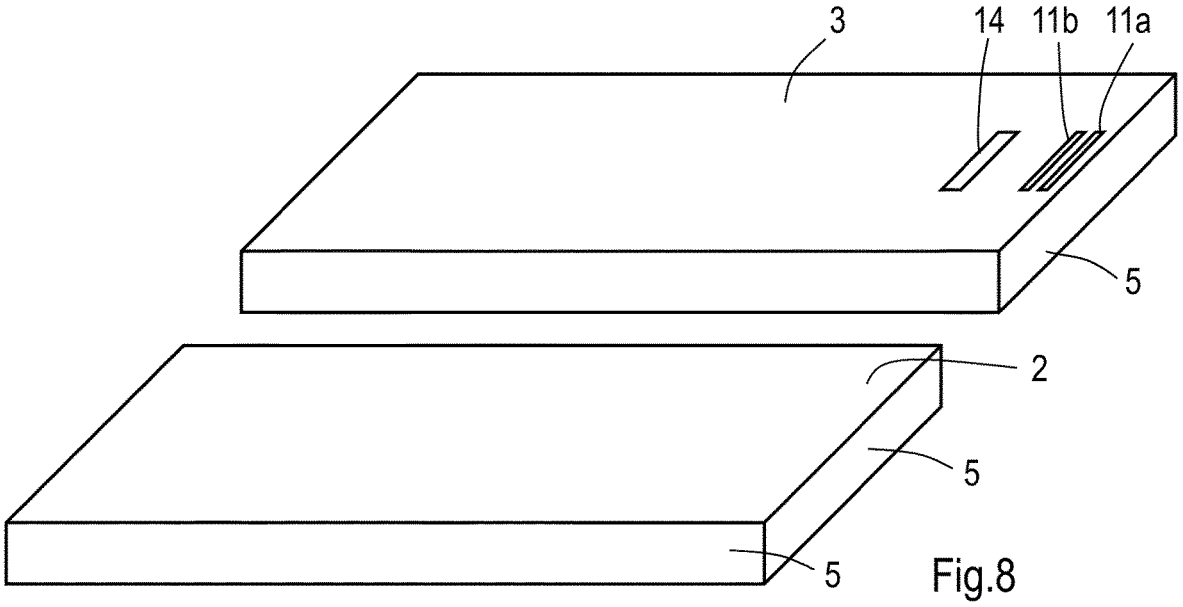

FIG. 8 shows a top and bottom view of a body support assembly of FIG. 5.

Figure 9:
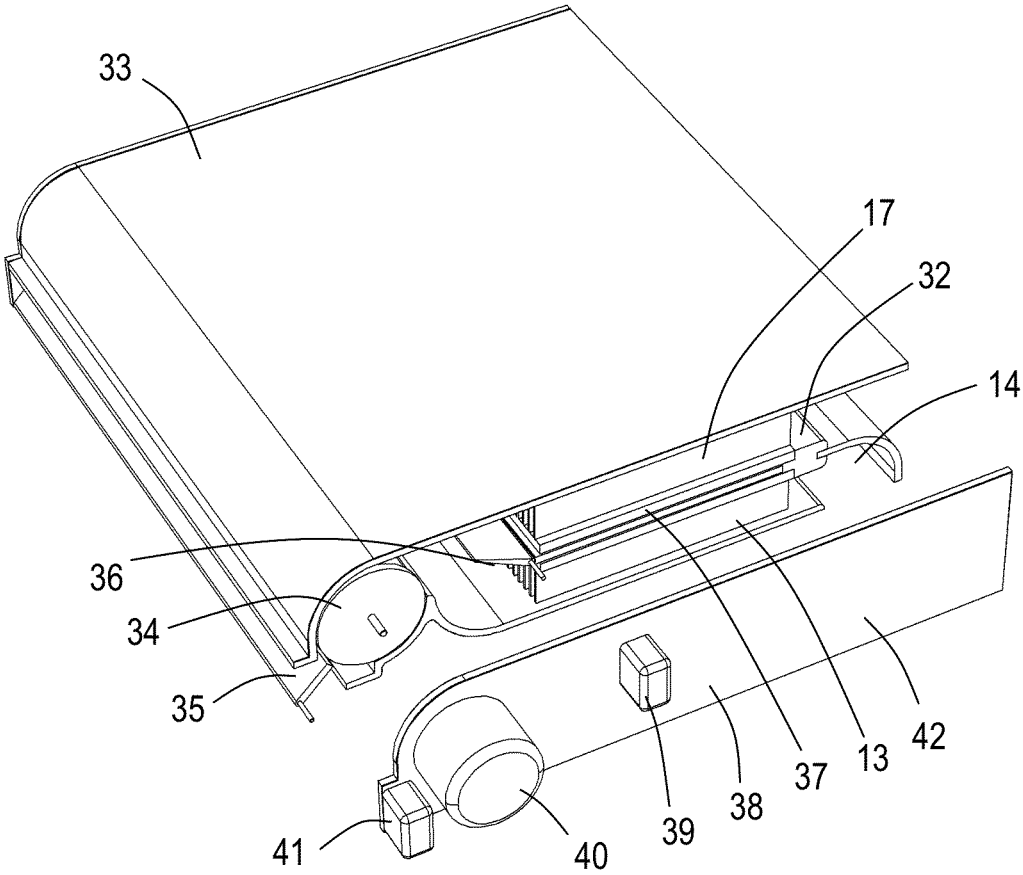
Figure 10A:
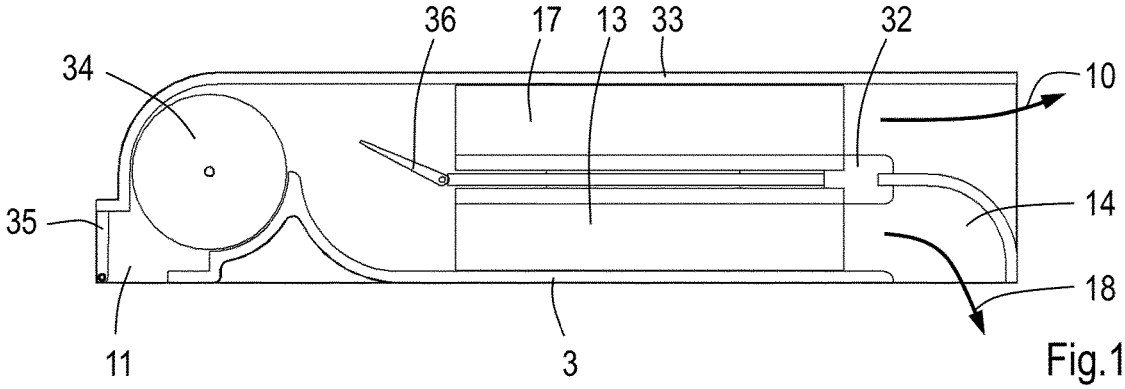
Figure 10B:
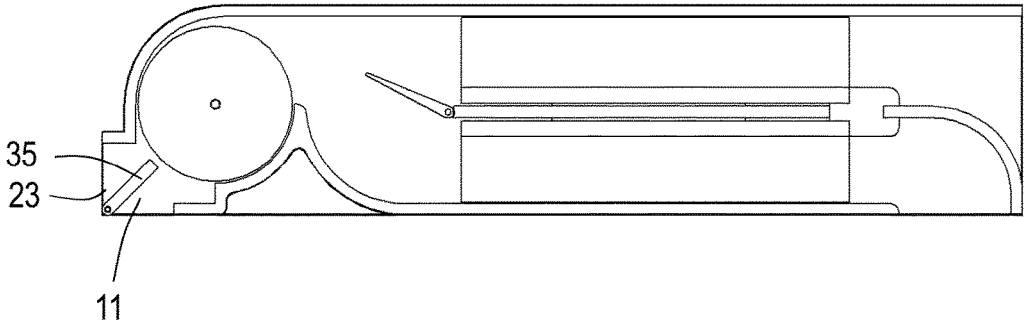
Figure 10C:
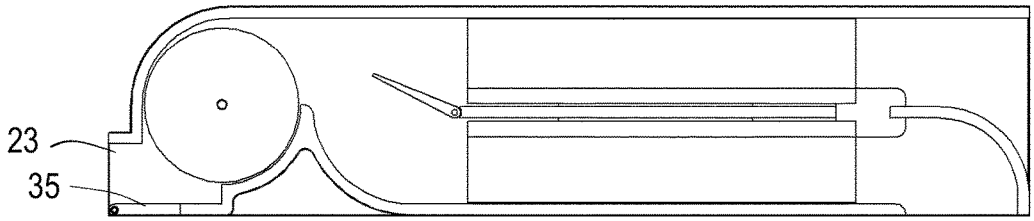

FIG. 9 shows another possible Peltier effect unit for the support assembly. This unit only has one ventilator (34) which can, depending on the position of valve (35), (i) draw in air from only air inlet opening (11) as shown in FIG. 10*a*, (ii) can draw in air only from the upper cushion zone (6) via opening (23) as shown in FIG. 10*c* and (iii) can draw in air from air inlet opening (11) and air from the upper cushion zone (6) as shown in FIG. 10*b*. Flap (36) will distribute this drawn in air flow over first and second heat exchanger (13,17). The unit is shown in FIG. 9 in combination with a spaced away side wall (42). When assembled this wall (42) will enclose the Peltier effect unit sideways. This side wall (42) is provided with an electric servo motor (41) to position valve (35), an electric motor (40) to operate the ventilator (34) and an electric servo motor (39) to position flap (36). This assembly thus has a first flow path according to the invention when valve (35) is in the positions as illustrated by FIGS. 10*a* and 10*b*.

The invention claimed is:

1. Body support assembly having a top surface for supporting a human body and a spaced away bottom surface defining a cushion volume and defining side walls, wherein the air permeability of the top surface is higher than the air permeability of the bottom surface and higher than the air permeability of the side walls, wherein the cushion volume comprises, an upper cushion zone nearest to the top surface and a lower cushion zone separated by a separation sheet, wherein the upper cushion zone and the lower cushion zone comprise of a compressible material which is permeable for air in all directions, a first flow path for ambient air comprising a single or separate air inlet opening at the bottom surface of the support assembly, air displacement means, a first heat exchanger and a single or separate air outlet opening at the bottom surface of the support assembly, a second flow path for air comprising an air inlet, air displacement means, a second heat exchanger, a flow path through the compressible material of the lower cushion zone, through openings in the separation sheet and through the compressible material of the upper cushion zone and multiple air outlets in the top surface, and wherein first heat exchanger and second heat exchanger are part of a Peltier effect unit positioned within the cushion volume, which unit is configured to cool the air in the first flow path and heat the air in the second flow path in one operating modus and/or to heat the air in the first flow path and cool the air in the second flow path in a second operating modus;

wherein a valve assembly is present which has a valve position which allows an air flow path in which air is allowed to circulate from the second heat exchanger via the lower cushion volume to the upper cushion volume and back to the second heat exchanger and a valve position which allows air to flow from an air inlet at the bottom surface of the support assembly via the second heat exchanger, via the lower cushion zone, via the upper cushion zone to an air outlet which comprises the air permeable top surface.

2. The body support unit according to claim 1, wherein the second flow path allows air to circulate from the second heat exchanger via the lower cushion volume to the upper cushion volume and back to the second heat exchanger.

3. The body support unit according to claim 1, wherein the second flow path allows air to flow from an air inlet at the bottom surface of the support assembly via the second heat exchanger, via the lower cushion zone, via the upper cushion zone to an air outlet which comprises the air permeable top surface.

4. The body support unit according to claim 1, wherein the valve assembly has valve positions which allow a combination of air flows wherein the second flow path allows air to circulate from the second heat exchanger via the lower cushion volume to the upper cushion volume and back to the second heat exchanger and wherein the second flow path allows air to flow from an air inlet at the bottom surface of the support assembly via the second heat exchanger, via the lower cushion zone, via the upper cushion zone to an air outlet which comprises the air permeable top surface.

5. The body support unit according to claim 1, wherein the Peltier effect heating and cooling unit is configured to cool the air in the first flow path and heat the air in the second flow path in one operating modus and to heat the air in the first flow path and cool the air in the second flow path in a second operating modus.

6. The body support unit according to claim 1, wherein the Peltier effect heating and cooling unit is configured to cool the air in the first flow path and heat the air in the second flow path in a single operation modus.

7. The body support unit according to claim 1, wherein the second heat exchanger is fluidly connected to an air outlet system with multiple air outlet openings within the compressible material of the lower cushion zone such that air is substantially evenly distributed within said lower cushion zone.

8. The body support unit according to claim 1, wherein the second heat exchanger is fluidly connected to an air outlet and wherein the openings per area of separation sheet increases for positions on the separation sheet which are spaced further away from the air outlet of the second heat exchanger.

9. The body support unit according to claim 1, wherein the body support assembly has an end for placement of the head of the human body and an end for placement of the feet of the human body and wherein the air displacement means, and first and the second heat exchanger of the Peltier effect element are positioned at the end for the feet.

10. The body support unit according to claim 1, wherein the Peltier effect unit is equipped with a heat exchange surface as positioned in the first and second air flows as the first and second heat exchangers.

11. The body support unit according to claim 1, wherein the Peltier effect unit is equipped with a heat exchange surface at its, in use, cold and hot side to heat and cool separate heat transfer mediums and means to transport the separate heat transfer mediums to the first and second heat exchanger to heat and/or cool the ambient air flowing through first and second air flow path.

12. The body support unit according to claim 1, wherein the compressible material which is permeable for air in all directions has an air permeability of greater than 100 $cm^3/s/cm^2$ as measured by ASTM D737 96.

13. A bed comprising a body support assembly according to claim 1 and a spiral wire mattress support.

14. A bed comprising a body support assembly according to claim 1 and a mattress support and wherein the power supply for the Peltier effect unit runs via the mattress support to the body supply assembly.

15. Method to cool or heat a body support assembly having a top surface for supporting a human body and a spaced away bottom surface defining a cushion volume and defining side walls, wherein the cushion volume comprises, an upper cushion zone nearest to the top surface and a lower cushion zone separated by a separation sheet, wherein the upper cushion zone and the lower cushion zone comprise of a compressible material which is permeable for air in all directions, and wherein ambient air flows in a first flow path via a single or separate air inlet openings at the bottom surface of the support assembly, air displacement means, a first heat exchanger and a single or separate air outlet opening at the bottom surface of the support assembly, wherein ambient air flows in a second flow path via an air inlet, air displacement means, a second heat exchanger, a flow path through the compressible material of the lower cushion zone, through openings in the separation sheet, through the compressible material of the upper cushion zone and through the top surface, and wherein the first and second heat exchangers are part of a Peltier effect heating and cooling unit and wherein in the first heat exchanger the air is cooled and in the second heat exchanger the air is heated in one operating modus and/or wherein in the first heat exchanger the air is heated and in the second heat exchanger the air is cooled in a second operating modus;

wherein a valve assembly is present which has a valve position which allows an air flow path in which air is allowed to circulate from the second heat exchanger via the lower cushion volume to the upper cushion volume and back to the second heat exchanger and a valve position which allows air to flow from an air inlet at the bottom surface of the support assembly via the second heat exchanger, via the lower cushion zone, via the upper cushion zone to an air outlet which comprises the air permeable top surface.

16. The method according to claim 15, wherein in the second flow path air circulates from the second heat exchanger via the lower cushion volume to the upper cushion volume and back to the second heat exchanger.

17. The method according to claim 15, wherein in the second flow path air flows from an air inlet at the bottom surface of the support assembly via the second heat exchanger, via the lower cushion zone, via the upper cushion zone to an air outlet which comprises the air permeable top surface.

18. The method according to claim 15, wherein in the first heat exchanger the air is cooled and in the second heat exchanger the air is heated in one operating modus and wherein in the first heat exchanger the air is heated and in the second heat exchanger the air is cooled in a second operating modus.

* * * * *